United States Patent [19]

Heynisch

[11] 4,204,399

[45] May 27, 1980

[54] WRISTWATCH

[75] Inventor: Hinrich Heynisch, Graefelfing, Fed. Rep. of Germany

[73] Assignee: Siemens Aktiengesellschaft, Berlin & Munich, Fed. Rep. of Germany

[21] Appl. No.: 929,496

[22] Filed: Jul. 31, 1978

[30] Foreign Application Priority Data

Aug. 3, 1977 [DE] Fed. Rep. of Germany ..... 2735021

[51] Int. Cl.[2] ..... G04B 19/06; G04B 19/30

[52] U.S. Cl. ..... 368/240; 368/242

[58] Field of Search ..... 58/4 A, 5, 6 R, 23 R, 58/23 A, 23 AC, 39.5, 50 R, 58 A, 57, 58, 57.5, 59, 12.5 R, 126 R, 127 R; 29/177

[56] References Cited

U.S. PATENT DOCUMENTS

| | | | |
|---|---|---|---|
| 3,596,462 | 8/1971 | Hayes | 58/127 R X |
| 3,651,634 | 3/1972 | Cooper | 58/50 R |
| 3,760,584 | 9/1973 | Dargent | 58/4 A X |
| 3,969,887 | 7/1976 | Fukumoto | 58/127 R X |
| 4,095,405 | 6/1978 | Tanaka | 58/127 R X |

*Primary Examiner*—Edith S. Jackmon

*Attorney, Agent, or Firm*—Hill, Van Santen, Steadman, Chiara & Simpson

[57] ABSTRACT

A watch, and more particularly a wristwatch is disclosed in which the hours are only displayed in an analog manner and the minutes are only displayed in a digital manner. In the suggested display concept, the time of day is not illustrated in multiple fashion, but rather in a partially analog and partially digital manner. An analog hour display immediately provides a first overview completely sufficing in many cases, whereas a precise display for minutes and, if necessary, for seconds in digital form supplements the feeling for time provided by the hour display with effortless precision. The analog display is advantageously formed by chronologically, consecutively actuated, luminescence elements normally grouped in the shape of a wreath ("quasi-analog display").

7 Claims, 1 Drawing Figure

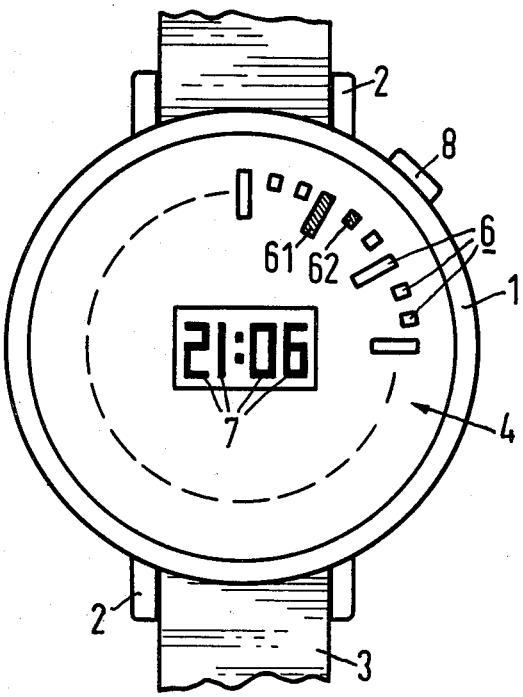
2
8
6
61
62
1
21:06
7
4
2
3

WRISTWATCH

BACKGROUND OF THE INVENTION

The invention relates to a clock, in particular to a wristwatch, in which at least the hour display proceeds in an analog manner and at least the minute display proceeds in digital manner. Such a clock is described in the German Offenlegungsschrift No. 2,324,826.

For a number of years, watches with digital display have been offered in addition to analog watches. Both types of illustration have their specific advantages and disadvantages: for the familiar analog display, one glance is sufficient in order to perceive the approximate time of day; however, the determination of the precise time sometimes poses problems. A digital display always provides a precise and comfortably readable time statement, however, in a non-conventional form (number sequence) which normally must yet be mentally processed.

Suggestions have been made how the advantages of the two display forms could be utilized while avoiding the disadvantages described. Thus, for example, the Offenlegungsschrift cited suggests to equip a watch not only with a digital but also with an analog display for hours and minutes.

However, experiments in conjunction with the present invention have determined that one is normally not readily capable of selectively perceiving only that type of display—for information offered in two different ways—which better suffices the momentary wishes; rather, it can be expected that a redundant illustration, burdening the viewer with a choice, has rather a confusing effect at first. Indeed, the double display mentioned is nevertheless associated with a considerable expense, requires a considerable structural design volume, and which could not penetrate the market.

SUMMARY OF THE INVENTION

It is an object of the invention to disclose a watch from which momentary time can be concluded immediately and without further thinking. In a watch of the invention, the hours are only displayed in analog manner and the minutes are only displayed in digital manner.

In the display concept suggested, the time of day is not illustrated in multiple fashion, but rather partially in analog and partially in digital manner, whereby the specifically selected allocation has been proven as particularly advantageous: the analog hour display immediately provides a first overview which in many cases suffices completely, whereas the feeling for time provided by the hour display is effortlessly supplemented in digital form by the precise display for minutes and, if necessary, for seconds.

A plurality of watch versions known of watches belong to the state of the art which illustrates specific information, for example, the hour display in an analog manner, and other information such as the date display is illustrated in digital manner. In addition, a liquid crystal display has also become known not only displaying in multiple ciphers but also in an analog manner in the form of a so-called "bar graph" (compare thereto the already cited Letters Patent and also Genschow "Technical Information Service", Edition A, No. 20 of 5/19/77, page 1). In all these known embodiments, however, components of a single information belonging together, for example, hours, minutes and seconds of the time of day, are always illustrated in one specific way.

If the suggested watch is to function without mechanically moving components, the analog display known per se is to be reproduced by means of chronologically consecutively actuated luminous elements, advantageously grouped in the shape of a wreath ("quasi-analog display"). The number of luminous elements is therefore twelve, twenty-four, or a multiple of twelve. The more elements which are utilized the better the advance of the hour display can be simulated and the more precise is the overview provided by the hour display.

It is recommended to provide the display of the suggested watch on the basis of liquid crystal displays (LCD's). However, other types of displays (electro-optical) can also be considered, primarily electrochromatic displays (ECD's), particularly solid member ECD's and electroluminescence displays. LCD's have an extremely low output requirement, LCD's and ECD's as passive displays have an extensive contrast independent of their surroundings at their disposal, and ECD's operate reliably even with relatively high temperatures. Finally, all three versions of display have a particularly low design depth and provide a clearly recognizable illustration even from oblique directions and from great distances. Primarily with the use of an LCD it is advantageous to carry out the minute and, if necessary, the second display in a time multiplex method, for there are already liquid crystal substances available which readily permit up to four multiplex steps.

Additional advantageous embodiments and further developments of the invention are the subject of additional claims.

BRIEF DESCRIPTION OF THE DRAWING

The drawing illustrates a wristwatch of the invention having an analog display for hours and a digital display for minutes.

DESCRIPTION OF THE PREFERRED EMBODIMENTS

The FIGURE, in a schematically illustrated front view, shows a wristwatch with a liquid crystal display. From the watch illustrated one can recognize a housing 1, a wrist band 3 directed through support bars 2 alongside of the rear wall of the housing, and the frontal side 4 of a liquid crystal display.

The liquid crystal display in the present case operates in accordance with the principle of the so-called "twisted nematic cell". Said cell consists of a frontal linear polarizer, a frontal carrier plate, a rear carrier plate and a rear linear polarizer crossed in relation to the frontal polarizer. The two carrier plates are spaced from one another via a frame, and the surfaces of said carrier plates facing one another are respectively provided with a conductive coating (continuous rear electrode or segmented frontal electrode). More precise production or operating details can be found in the German Offenlegungsschrift No. 2,158,563 incorporated herein by reference.

The frontal electrode segments in the present case are provided in the following manner: 36 segments 6 are situated on the edge of the frontal side and indeed in a peripheral direction in equal distances in order to display the hours. Every third segment thereby has a longitudinal form and extends in a radial direction. The remaining hour segments are square or round. The minutes and seconds are displayed by segments 7, placed in the center of the frontal side and adding up to a 4½ ciphered figure.

The watch is operated in the following manner:

At the time 13:21:06, the segments 61,62 of the hour segments are illuminated. The viewer is thereby informed that it must be between $13^{20}$ and $13^{40}$ hours. Moreover, the minutes and seconds segments 7, addressed in a 4 step time multiplex procedure (the equivalent segment electrodes of the four cipher locations belong to a signal line, the rear electrode lying opposite the segment electrodes of a cipher location belonging to an address line), are actuated such that the cipher "21:06" appears.

A knob 8 is mounted at the housing edge, said knob switching on a light source (not illustrated) in the form of a glow lamp or of a light-emitting diode situated behind the liquid crystal display, when pressed. The light source is to illuminate at least the hour display elements.

Particular advantages result with the following arrangement:

A plate ("fluorescent plate") metallized at its lateral surfaces is located behind the liquid crystal display in the viewing direction, said plate consisting of a material having a refractive index greater than 1, containing fluorescing particles, and respectively having an exit window behind the frontal electrode segments; the liquid crystal display per se is simultaneously designed such that in a rest condition, the excitation light or the fluorescent materials can pass through; the emission light, however, is blocked. One such embodiment supplies a particularly high illustration contrast as the fluorescent plate collects the inciding light by means of fluorescence scattering and subsequent (total) reflections, conveys it within the interior, and again gives it off towards the front through the exit windows with increased intensity. For more precise details, the patent applications P 25 54 226.1 and P 27 24 748.9, or the article with the title "Light and Economical" published in "Electronics-News" of 3/25/77 are noted and incorporated herein by reference.

The invention does not limit itself to the sample embodiment illustrated. Thus, one may provide the analog hour display in other ways such as the classical hour hand. In the quasi-analog display, the twelve luminescence elements for the full hours could also be designed as ciphers and/or the remaining elements could be provided with a size respectively decreasing towards the full hour. It is therefore not always required to simultaneously actuate several adjacent elements. In simple designs, the seconds display could also be spared. Moreover, the concept of this invention cannot only be used with wristwatches but also with other timing or stopping equipment. Thus, for example, inventively designed stop watches are also imaginable in which 1/10 seconds would also have to be additionally digitally displayed.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A method of displaying time of day on a display face of an electronic watch, comprising the steps of:

(a) providing an hour analog display formed of a first group of 12 luminescent elements arranged as a wreath corresponding to each full hour and a second group of luminescent elements of dimensions differing from the first group, elements of the second group being symmetrically arranged around the wreath and between adjacent full hour elements so as to represent fractions of full hours;

(b) providing a minute digital display formed of luminescent elements within the hour analog display wreath;

(c) displaying hours and fractions of hours in analog manner and not in digital manner on the face of the watch by chronologically activating only one of the first group luminescent elements corresponding to a full hour and also simultaneously activating in sequence all luminescent elements of the second group consecutively following the illuminated full hour element; and (d) displaying minutes in digital manner and not in analog manner on the face of the watch by activating the minute digital display.

2. The method of claim 1 including the step of providing the elements of the second group with a shorter length dimension than elements of the first group.

3. The method of claim 1 wherein the minute and hour displays are continuous liquid crystal displays and the minute display occurs along with the hour display.

4. The method of claim 1 further including the step of displaying minutes by time multiplex actuation.

5. The method of claim 4 further including the step of also displaying seconds by time multiplex actuation.

6. The method of claim 1 further including a digital display of seconds along with the digital display of minutes.

7. The method of displaying time of day on a display face of an electronic watch, comprising the steps of:

(a) providing an hour analog display formed of n·12 luminescent elements arranged as a wreath corresponding to each full hour and n equal length fractions or segments of each full hour, the luminescent elements representing the hour fractions being arranged between corresponding adjacent full hour elements and also being of a dimension different than the full hour elements;

(b) providing a minute digital display formed of luminescent elements within the hour analog display wreath;

(c) displaying hours and fractions of hours in analog manner and not in digital manner on the face of the watch by chronologically activating the hour display elements by displaying a time point which falls into an i-th segment of a given hour ($i=1 \ldots n$) by actuating a luminescent element assigned to the chronologically preceding full hour and also subsequent i–1 luminescent elements respectively assigned to i–1 first segments of the given hour; and (d) displaying minutes in digital manner and not in analog manner on the face of the watch by activating the minute digital display.

* * * * *